US005228170A

United States Patent [19]

Giuliani

[11] Patent Number: 5,228,170

[45] Date of Patent: Jul. 20, 1993

[54] CARD FOR COTTON AND FOR SIMILAR USES, WITH FIXED CARDING FLATS WHICH FORM CLEANING MEMBERS

[76] Inventor: Marcello Giuliani, Via Cellerese No. 33, 50013 Campi Bisenzio, Firenze, Italy

[21] Appl. No.: 898,013

[22] Filed: Jun. 12, 1992

[30] Foreign Application Priority Data

Jun. 25, 1991 [IT] Italy ..... FI91A 158

[51] Int. Cl.[5] ..... D01G 15/12; D01G 15/02

[52] U.S. Cl. ..... 19/104; 19/113

[58] Field of Search ..... 19/104, 113

[56] References Cited

U.S. PATENT DOCUMENTS 4,271,564 6/1981 Estebanell ..... 19/104 X
4,314,387 2/1982 Löffler ..... 19/104 X
4,593,437 6/1986 Graf et al. ..... 19/113

FOREIGN PATENT DOCUMENTS 0366918 5/1990 European Pat. Off. ..... 19/104
0094623 5/1985 Japan ..... 19/104
1602887 10/1990 U.S.S.R. ..... 19/113

*Primary Examiner*—Clifford D. Crowder
*Assistant Examiner*—John J. Calvert
*Attorney, Agent, or Firm*—Hopgood, Calimafde, Kalil, Blaustein & Judlowe

[57] ABSTRACT

A card suitable for cleaning cotton fibers and other fibrous materials is provided. The card comprises fixed carding flats adjacently disposed about a peripheral portion of a rotatable cylinder adapted to receive clothing on the surface thereof. Each of the flats comprises a group of spaced parallel blades arranged in alternate sequence with a group of distance or separator pieces and held fast thereto. The fixed carding flats are characterized by a forward end face with the spaced blades extending to the end face, the end face being disposed against the rotational direction of said cylinder. The forward end face of each of the carding flats is inclined such that the blades extending to the end face are disposed at an acute angle relative to the clothing fed to the surface of said cylinder for removal of impurities therefrom.

6 Claims, 2 Drawing Sheets

Figure 2:
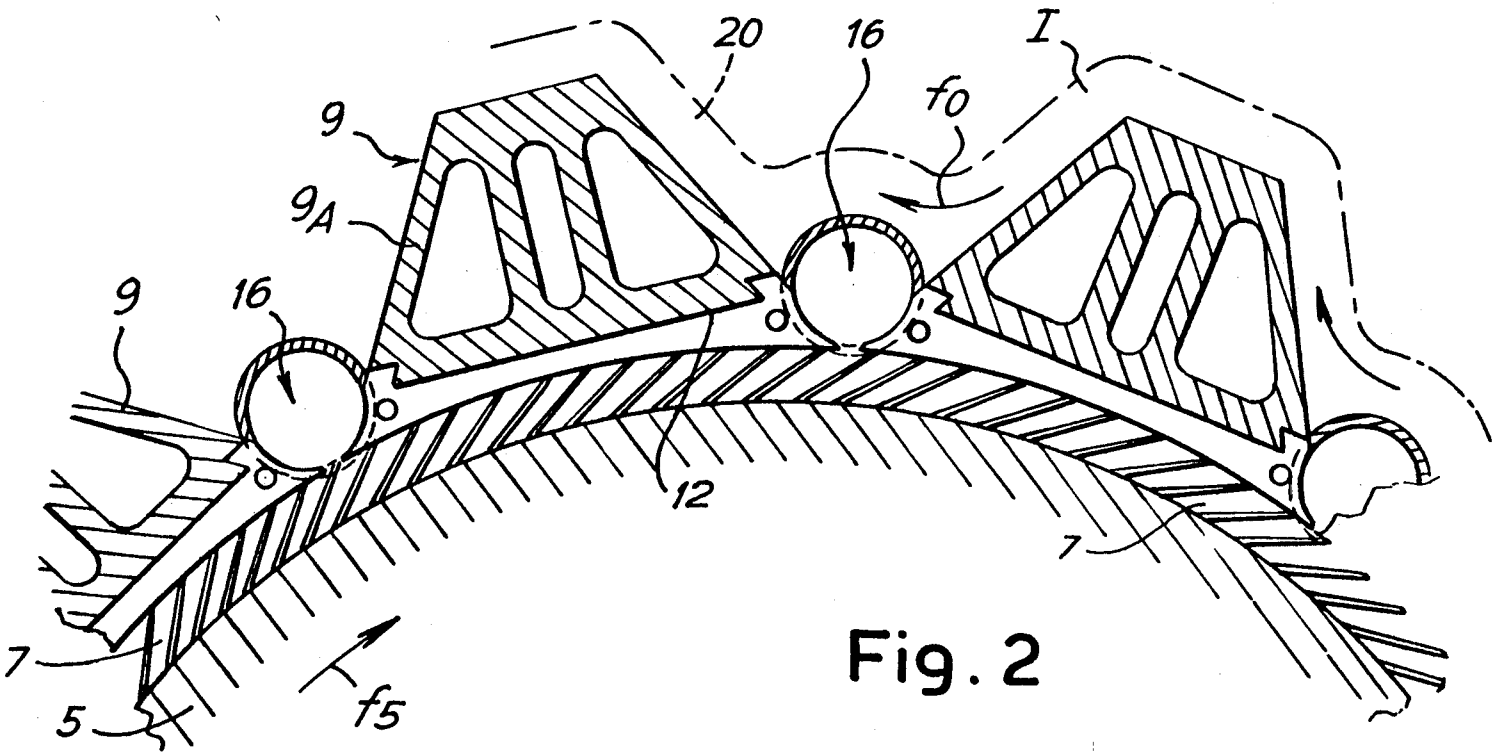

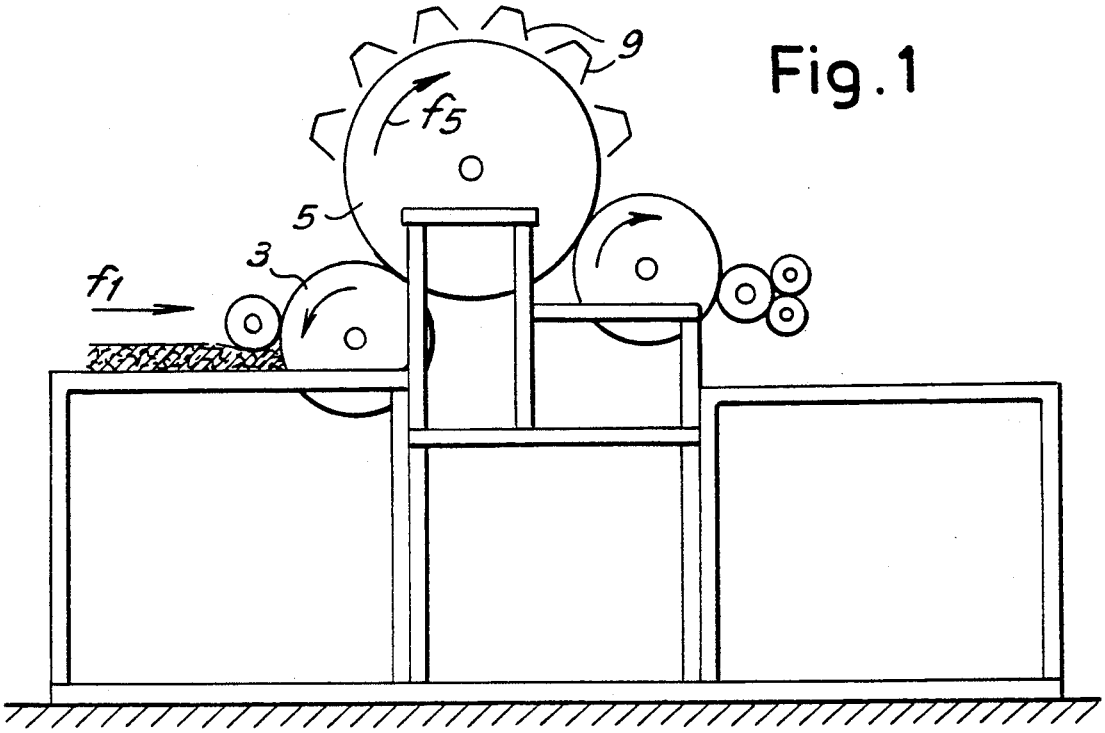
Fig. 1
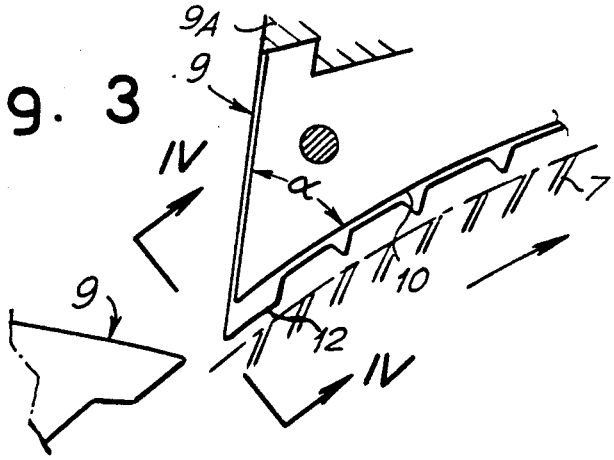
Fig. 3
Fig. 4
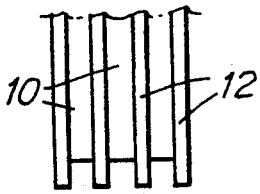
Fig. 6
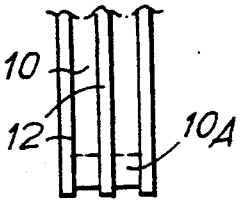
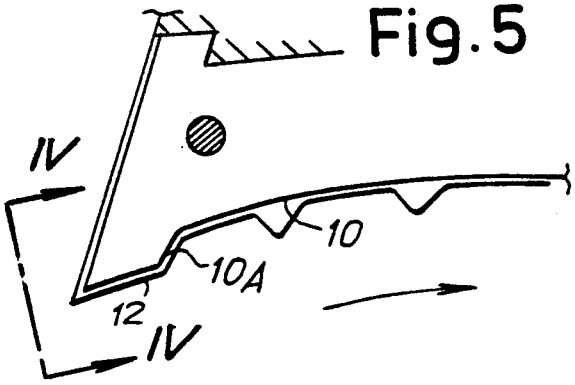
Fig. 5

CARD FOR COTTON AND FOR SIMILAR USES, WITH FIXED CARDING FLATS WHICH FORM CLEANING MEMBERS

DESCRIPTION

The operation of carding consists essentially in separating the discontinuous fibers, at the same time freeing them from the impurities still present and completing in this manner the opening and the cleaning initiated in the preceding operations. In cards with flats, the carding action is carried out mainly between the main cylinder which rotates at high speed and a series of rotating flats or a series of fixed flats. The main cylinder and the flats —both those in movement and those which are fixed —are covered with a close-packed rigid clothing formed from steel teeth which are opposed between the teeth of the main cylinder and the teeth of the flats. The rubbing between the teeth creates the carding. The cards with flats serve to create a band by parallelizing the fibers and removing the impurities of the same.

The flats rotating with the carding action cyclically bring the clothings to the outside, above the carding cylinder; on the way out, said clothings are cleaned by a blade in movement. Unfortunately, these flats remove only some impurities and not all, but also remove fibers of a suitable length for creation of the thread, thus discarding and losing fibers also which would be useable for spinning. In the solution with fixed flats, the same only card and do not remove impurities. To remove the impurities, additional inclined blades have until today been applied at various points of the main carding cylinder, increasing the expenditure for the construction of the cards and for maintenance, and limited cleaning is obtained, given the small number of cleaning blades.

With the present invention, the carding and the cleaning of the fiber is simplified, with adoption of carding flats of fixed type. With the present invention, moreover, better parallelization of the fibers, better cleanness, lower loss of fibers, avoiding having useful fibers discarded, and greater production which varies from 20% to 70% are obtained. The present invention also makes possible the adoption of a suction or other special air circulation, with which the heating of the material and the consequent softening of certain impurities and the negative consequences on the functioning of the card are avoided.

Essentially —according to the invention - in a card for cotton and for other uses, comprising fixed carding flats, at least those ends of the components of the flats turned toward the arriving clothing of the cylinder are given an acute angle (of the order of approximately 45°), thus also functioning as cleaning members for the removal of the impurities, through the spaces between adjacent flats. Clothings with teeth of the existing types can be used equally well.

According to a known technique, the fixed flats are formed by blades and by distance pieces or separators interposed between the blades; in this case, the ends of the blades and of the distance pieces are given an acute angle. In this case, according to a possible embodiment, the front ends of the distance pieces can be extended also to come side by side with the ends of the blades formed at an acute angle, and are shaped like those ends of the blades. In any case, an inclined transverse cleaning blade is constituted.

In its oblique form, the flat can therefore have a comb-like or smooth form; comb-like serves for cleaning even the most microscopic impurities in the entire circumference of the fiber; the smooth form (blade type) serves for cleaning normal impurities. This flat without any further application becomes a flat cleaning the impurities of the fiber. In a card, therefore, there is provision to apply various flats and each flat has its oblique form cleaning the impurities of the fibers; all carding points are thus also cleaning points.

The acute-angled ends can have an angular size of approximately 45°.

The opposite ends also of the components of the flats can be at an acute angle, increasing the discharge spaces between adjacent flats.

In the spaces between adjacent flats, channels parallel to the flats and open toward the clothing of the cylinder can be formed, and means are provided for creating pneumatic currents for suction of the impurities separated by said shaped ends.

By having both the ends of the blades of the various adjacent flats shaped at an acute angle, there are created between adjacent flats interspaces with ample opening in the centrifugal direction for discharge of the impurities, for the arrangement of any channels for pneumatic suction currents, and also for making it possible to define a hollow space for circulation of fluid for cooling the flats, for the purposes indicated above.

The width of the interspace is adjusted according to the length of the fiber, of the impurities and of the short fibers which it is desired to eliminate in working. The suction of the impurities also makes it possible to cool the flats, making the same stay at a constant temperature.

In short, the possibility of better carding, of better cleanness and of less breakage of fibers is obtained, and consequently also a very regular band and a substantial increase in production, with minimum loss of useful fibers.

The invention will be better understood by following the description and the attached drawing which shows a non-limiting practical illustrative embodiment of the invention itself. In the drawing FIG. 1 shows a general simplified diagram of a card;

FIG. 2 shows in cross-section a part of the cylinder of the clothing with its flats made according to the invention;

FIGS. 3 and 4 show an enlarged detail of the ends of two adjacent flats and a view from the line IV—IV in FIG. 3, and FIGS. 5 and 6 are similar to FIGS. 3 and 4 but show a solution which is modified as compared to FIGS. 3 and 4 themselves.

According to FIG. 1, Fl indicates the feed of the material which is supplied from the cylinder 3 to the cylinder 5 which rotates in the direction of the arrow f5 and which has a carding clothing indicated by 7 and more clearly visible in FIG. 2.

9 indicates the fixed flats which are made according to the invention but with the known technique which provides for the formation of the active components of the flats with series of alternate blades and distance pieces, or separators as is shown in particular in FIGS. 3 to 5. Engaged alternately on support structures 9A, by means of suitable outlines and fixing means, are both distance pieces 10 and shaped blades 12 with the points which are to interact with the clothing 7.

According to what is illustrated in the drawing, the ends of the components 10 and 12, in particular at least those which are turned toward the clothing 7 arriving in the direction of the arrow f5, are given angles a of the order of approximately 45° and at any rate such that the channels which are formed between adjacent flats 9 are open toward the outside, that is to say in the centrifugal direction, which facilitates the discharge of the waste and of the impurities.

According to the solution in FIGS. 3 and 4, the distance pieces 10 have a continuous profile which is slightly set back in relation to the external surface of the clothings 7, while the outlines of the blades 12 reach and skim this clothing 7; the result is a toothed form in the view according to FIG. 4 of the group of adjacent components 10 and 12. According to the alternative in FIGS. 5 and 6, however, the distance pieces 10 also are given extensions 10A at their ends, in such a manner that these extensions 10A become level with the end points of the blades 12 to constitute a continuous and therefore not toothed front, as can be seen from the comparison between FIGS. 6 and 4; this continuous front constitutes a transverse cleaning blade which assists the discharge of the impurities through the interspaces between the adjacent flats 9.

It is possible, as shown in FIG. 2, to envision the formation of channels, generally indicated extending by 16 and developed transversely in relation to the clothing of the cylinder 5, in the interspaces between adjacent flats. These channels 16 are open toward the clothing 7 and suction currents are formed in these which are capable of removing easily the impurities collected by the flats. It can be envisioned that the suction is brought about only at one end of the channel 16 or and advantageously at both the ends, to make the suction effect uniform over the entire front represented by the interspace between adjacent flats. The presence of the channels, which are of circular cross-section, may require that the profiles of the backs of the blades and of the distance pieces be shaped with a certain concavity.

The structure described, in addition to offering the advantages already mentioned of assisting the cleaning of the clothing and the discharge of the impurities, also makes it possible easily to apply a system for cooling the working zones of the flats and of the clothing 7, so as to avoid the overheating of the components and the risk of plasticization of some of the, above all natural, impurities of cotton, which in the long run can cause an obstacle to the smooth running of the card. In fact, with the arrangement described, it is easy to create a hollow space I and a cooling current of (FIG. 2) which flows over and licks and therefore cools the flats and the walls of the channels 16, thus bringing about that lowering of temperature which is required for the purposes mentioned above.

It will be understood that the drawing only shows an illustrative embodiment which is given only by way of practical demonstration of the invention, it being possible for the invention to vary in form and arrangement without thereby leaving the scope of the idea which forms the invention itself. The presence of any reference numbers in the enclosed claims has the purpose of facilitating reading of the claims with reference to the description and to the drawing, and does not limit the scope of protection represented by the claims.

In summary, the invention provides a card suitable for cleaning cotton fibers and other fibrous materials. The card comprises fixed carding flats 9 adjacently disposed about a peripheral portion of a rotatable cylinder 5 adapted to receive clothing on the surface thereof. Each of the flats comprises a group of spaced parallel blades 12 arranged in alternate sequence with a group of distance or separator pieces 10 and held fast thereto. The fixed carding flats 9 are characterized by a forward end face with the spaced blades 12 extending to the end face, the end face being disposed against the rotational direction of cylinder 5. The forward end face of each of the carding flats is inclined such that the blades extending to the end face are disposed at an acute angle, e.g., 45°, relative to the clothing 7 fed to the surface of cylinder 5 for removal of impurities therefrom.

I claim:

1. A card suitable for cleaning cotton fibers and other fibrous materials, said card comprising:

fixed carding flats adjacently disposed about a peripheral portion of a rotatable cylinder having means for receiving clothing on the surface thereof, each of said flats comprising a group of spaced parallel blades arranged in alternate sequence with a group of distance or separator pieces and held fast thereto, each of said fixed carding flats having a forward end face with said spaced blades extending to said end face, said end face being disposed against the rotational direction of said cylinder, said forward end face of each of said carding flats being inclined such that the blades extending to said end face are disposed at an acute angle relative to the peripheral surface of said cylinder for removal of impurities therefrom.

2. The card as in claim 1, wherein said separator pieces between said blades extend to the end face together with said blades, and wherein said end face constitutes a transverse cleaning blade inclined at said acute angle.

3. The card as in claim 1, wherein said acute angle is approximately 45°.

4. The card as in claim 1, wherein each flat has an inclined rearward end face also disposed at an acute angle, and wherein said blades extend to said rearward end face, the adjacently disposed flats providing interspaces with ample opening to provide for means for removing impurities during carding of said fibrous material.

5. The card as in claim 4, wherein said interspaces between said adjacent flats are provided with channel means with an opening facing said clothing for use in pneumatically removing impurities from said clothing during the carding thereof.

6. The card as in claim 5, wherein said flats are surrounded by a spaced enclosure for passing air as a coolant therethrough for controlling the temperature during the carding of fibrous material.

* * * * *